United States Patent [19]

Johnston

[11] Patent Number: 4,895,256

[45] Date of Patent: Jan. 23, 1990

[54] AIR CONDITIONING SUPPLY CARRIER

[76] Inventor: James E. Johnston, 10810 SW. 84th St., #7A 1, Miami, Fla. 33173

[21] Appl. No.: 359,093

[22] Filed: May 30, 1989

Related U.S. Application Data

[63] Continuation of Ser. No. 200,724, Sep. 23, 1988.

[51] Int. Cl.[4] ..... B65D 21/02

[52] U.S. Cl. ..... 206/501; 206/349; 206/503; 206/509; 206/511; 206/821; 206/203; 220/4 D; 220/20; 294/161

[58] Field of Search ..... 206/349, 372, 373, 501, 206/503, 509, 510, 511, 514, 821, 201, 202, 203; 220/4 D, 20, 22; 294/158, 159, 160, 161, 172; 211/126, 133

[56] References Cited

U.S. PATENT DOCUMENTS

| | | | |
|---|---|---|---|
| 624,005 | 5/1899 | Forbes | 294/161 |
| 1,010,801 | 12/1911 | Rapp | 206/51 |
| 1,614,910 | 1/1927 | Yardor | 220/22 |
| 2,341,635 | 2/1944 | Loesch | 294/158 |
| 3,392,874 | 7/1968 | Peebles | 206/509 |
| 3,627,122 | 12/1971 | Garbe | 206/51 |
| 3,902,270 | 9/1975 | Moleamar | 211/126 |
| 4,311,237 | 1/1982 | Hayes | 206/203 |
| 4,460,085 | 7/1984 | Jantzen | 206/373 |
| 4,744,613 | 5/1988 | Brantingham | 206/349 |

FOREIGN PATENT DOCUMENTS

| | | | |
|---|---|---|---|
| 2427383 | 11/1975 | Fed. Rep. of Germany | 206/372 |
| 2129285 | 5/1984 | United Kingdom | 206/509 |

*Primary Examiner*—George E. Lowrance
*Attorney, Agent, or Firm*—Malloy & Malloy

[57] ABSTRACT

In air conditioning supply carrier and organizer including a lower tray, an upper tray and an intermediate tray in stacked relation, each tray being of substantially similar area and configuration wherein the interior of each tray is separated by septums into a plurality of compartments and wherein an upstanding handle on the lower tray extends through openings in the intermediate and upper trays for orienting the trays in stacked relation and for carrying either one, two or all three trays at one time to a job site.

4 Claims, 2 Drawing Sheets

AIR CONDITIONING SUPPLY CARRIER

BACKGROUND OF THE INVENTION

This application is a continuation of my earlier filed patent application Ser. No. 07/200,724 filed on Sept. 23, 1988.

1. Field of the Invention

This invention relates to a supply carrier, composed of a plurality of stacked trays each of which is separated into a plurality of compartments for organizing and carrying items.

2. Background of the Invention

Repairmen, especially air conditioning repairmen, are required at a job site, depending upon the type of repair, to have carpentry items, electrical items and plumbing items. Often times at a job site, it is not possible to gain access with a truck. For this reason, the repairman is often required to make numerous trips back and forth to the truck in order to get necessary supplies. This invention is of a supply carrier and organizer which is highly useful in organizing and carrying the required range of items needed at a job site. It is composed of three trays, which can be separated from one another and carried to the job site, either as a single tray, two trays or three trays.

OBJECTS OF THE INVENTION

It is an object of this invention to provide a supply carrier and organizer for use by a repairman, especially at an air conditioning site.

DESCRIPTION OF THE DRAWINGS

For a fuller understanding of the nature of the present invention, reference should be had to the following detailed description taken in connection with the accompanying drawings in which.

DETAILED DESCRIPTION OF THE PREFERRED EMBODIMENT

Figure 1:
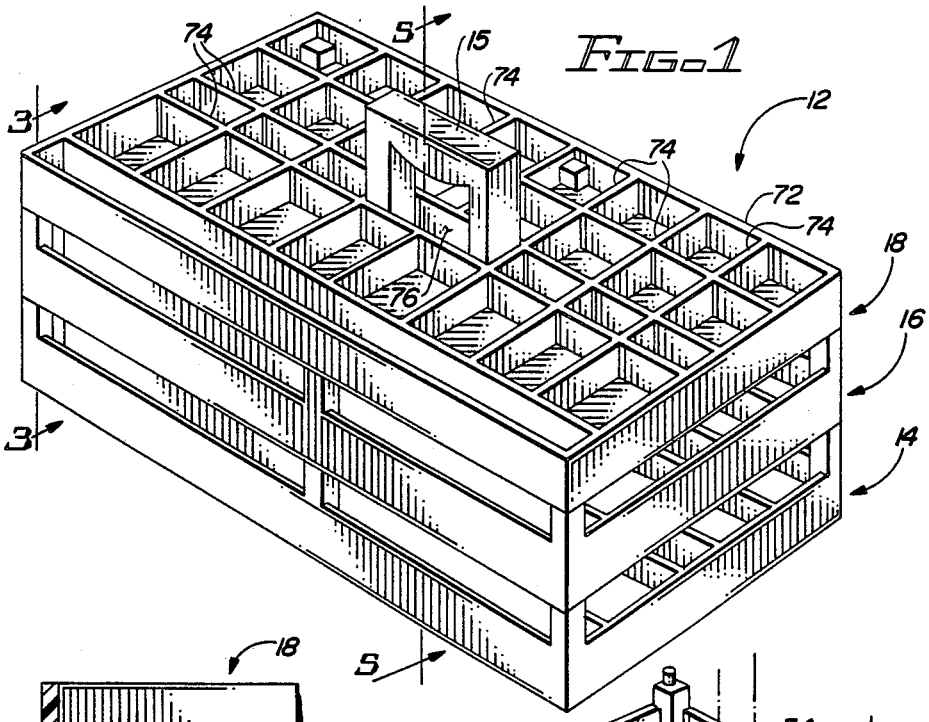
FIG. 1 is a perspective view of the supply carrier.

The supply carrier generally designated by the normal 12 is composed of an assembly of a lower tray 14 with an upstanding centrally arranged inverted U-shaped handle 15 and, in stacked relation with the lower tray, an intermediate tray 16 and an upper tray 18. The interior of each of the trays is separated by septums, such as 20, into compartments such as 22, which are of various sizes.

The lower tray 14, in addition to the handle 15, is provided with corner posts such as 26, 28, 30 and 32 of a common height each with a locator pin such as 26', 28', 30' and 32' extending upwardly from the upper terminal end of each post. The lower tray has a flat floor 31 and peripheral walls 33, 35, 40 and 42. Posts 34 and 36 may be provided between the corner posts along the longitudinally extending side walls 40 and 42. In the preferred embodiment, there may be a longitudinal septum such as 43 to define a long compartment 44 for rulers and the like.

Figure 3:
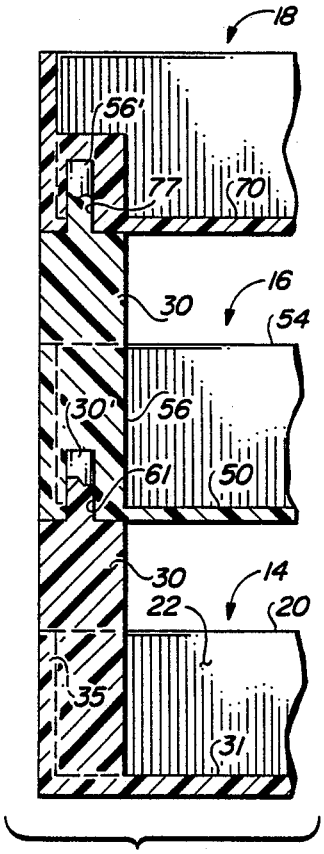
FIG. 3 is a partial view in cross-section taken on the plane of line 3—3 of FIG. 1 and looking in the direction of the arrows.
Figure 2:
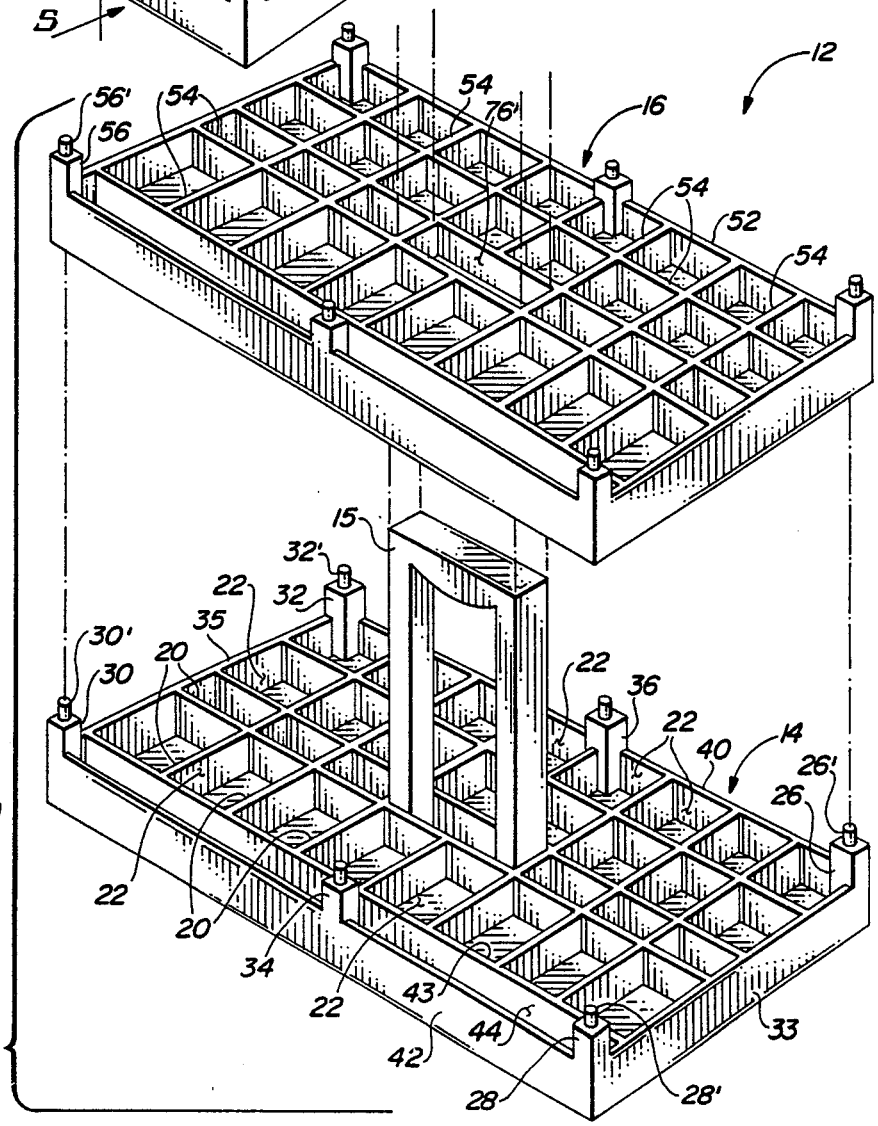
FIG. 2 is a partial exploded perspective view of the carrier.
Figure 4:
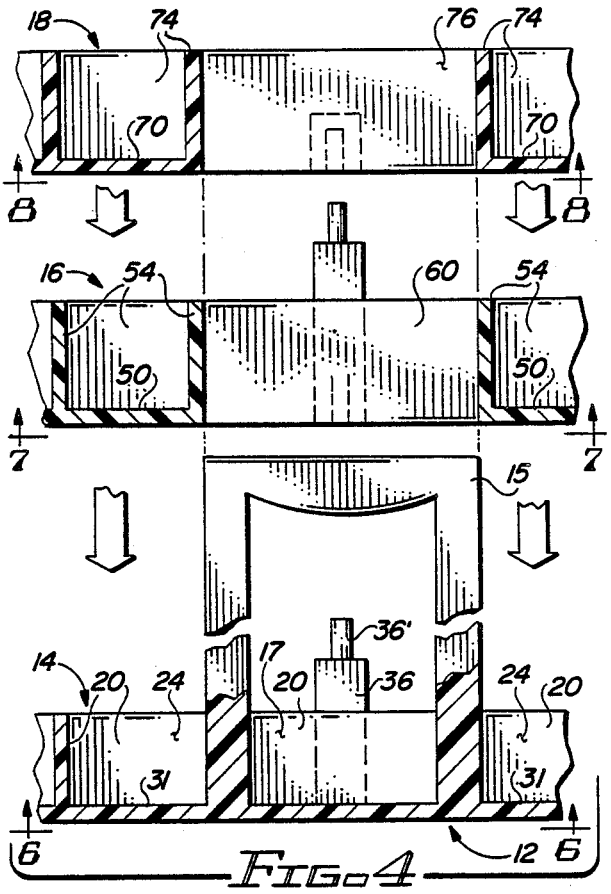
FIG. 4 is a partial exploded view in cross section taken on the plane of the line 5—5 of FIG. 1 and looking in the direction of the arrows.
Figure 5:
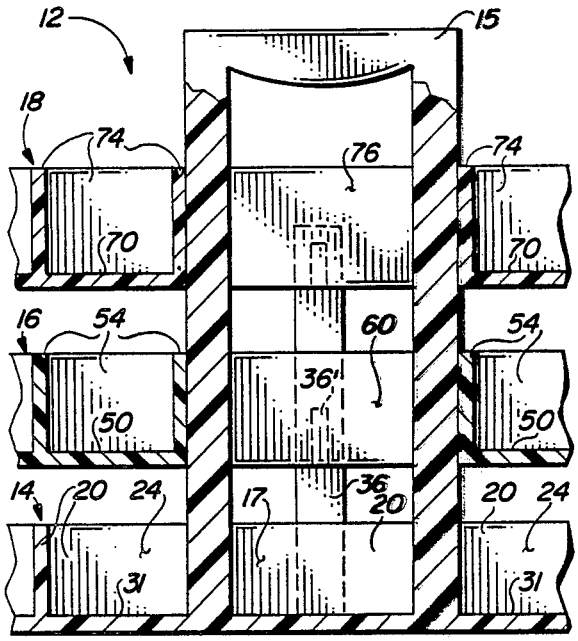
FIG. 5 is a partial view in cross-section taken on the plane of the arrowed line in FIG. 1 looking in the direction of the arrow.
Figure 6:
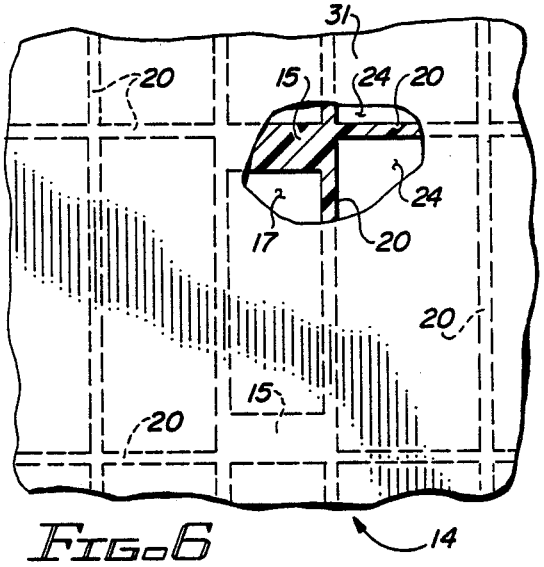
FIG. 6 is a partial view partly in cross-section taken on the plane indicated by the line 6—6 in FIG. 4.
Figure 7:
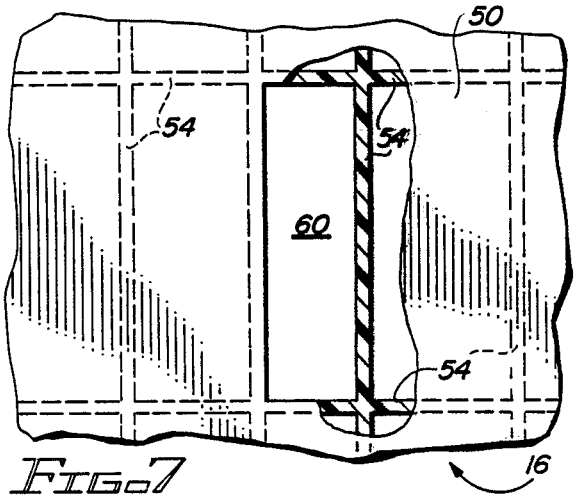
FIG. 7 is a partial view in cross-section partly taken on the plane indicated by the line 7—7 of FIG. 4.
Figure 8:
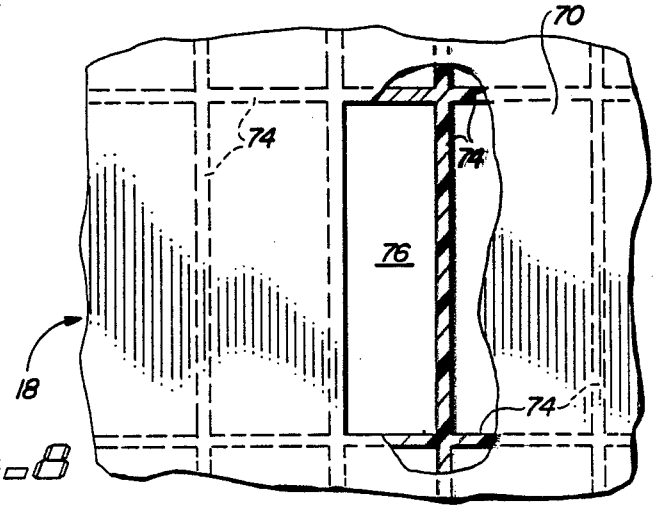
FIG. 8 is a partial view, partly in cross-section and taken on the plane indicated by the line 8—8 in FIG. 4 looking in the direction of the arrows.

The intermediate tray 16 has a floor 50 peripheral walls such as 52 and septums such as 54 separating the interior into a plurality of compartments. It is provided with the corner posts such as 56 with a locator pin 56' in each. Additional post supports may be provided. There is a central wall arrangement 76' defining a passageway 60 sized and configured for positioning over the upstanding handle 15 on the lower tray. In the floor 50 beneath each post there is provided a recess, such as 61, see FIG. 3, to receive the pin 30 of the corner post 30. Similarly, the locator pins in the other posts are received in a recess provided in the floor of the intermediate tray.

The upper tray 18 has a floor 70 and together with the peripheral wall 72 and septums 74 define compartments therein. There is a central opening 76 sized and configured for passage of the handle 15. In the lower surface of the floor 70 recesses such as 77, are provided the same being sized and located to receive the upwardly extending pins such as 56' of the intermediate tray.

In assembly, the intermediate tray is positioned with the handle 15 extending through the wall arrangement 76' defining opening 60 in stacked relation to the lower tray. In the recesses 61, the pins such as 30', are received. Similarly the top tray is positioned over the handle with the upstanding pins on the intermediate tray in the recesses such as 77 in the floor 70 of the top tray.

Preferably, the supply carrier has a longitudinal dimension of 24 inches inside the peripheral walls and 24 and ¼ inches outside the peripheral walls and has a width of 10 inches inside the peripheral walls and 10 and ¼ inches outside of them. The height of the peripheral walls of each of the trays is about two inches and the posts extend upwardly from the lower and intermediate tray about 1 and ½ inches serving as tray spacer means.

It is thus then seen that the carrier is composed of 3 trays which may be color coded and stacked for use by a repairman to keep an accurate inventory and which provides quick and easy access to repair parts at a work site. Preferably the product is of sturdy rigid molded plastic with no moving parts or hinges. Preferably the septums of each of the trays separate the interior of each into 16 compartments which are 3 inches×2¼ inches plus 8 compartments which are 3½ inches×3 inches plus a single long compartment extending 24 inches which is 1 inch wide.

In assembly, the 3 trays are vertically stacked, one on top of the other.

This structure permits a repairman to carry 1, 2 or 3 trays to the work site depending upon the complexity of the job. For example, in the lower tray plumbing supplies may be stored, in the middle tray electric supplies may be stored and in the top tray carpentry items may be stored. It will be appreciated that such a carrier is useful especially by air conditioning repairman who are often required to make frequent trip to their truck from the actual site of the air conditioning equipment being repaired.

While this invention has been shown and described in what is considered to be practical and preferred embodiment, it is recognized that departures may be made within the spirit and scope of this invention.

What is claimed is:

1. A supply carrier for use by an air conditioning repair man comprising, a lower tray, an upper tray and an intermediate tray, each tray being of substantially similar area and configuration as seen in plan, said tray each having a bottom peripheral walls and septums defining a plurality of compartments within each tray of various sizes, said lower tray including a centrally arranged upstanding inverted generally U-shaped handle comprising a first and a second leg and a top carrying bar type handle and, said lower tray including corner posts of common size each extending upwardly of the peripheral walls to a terminal end and each including a central upwardly extending pin, said intermediate tray having recesses in the floor sized configured and located to receive the pins of the lower tray and said intermediate tray being supported in assembly on the corner posts, and said intermediate tray having a central passage way for passage of the handle through the intermediate tray when in stacked relation on the lower tray, and said intermediate tray including four corner support posts of common size extending upwardly of the peripheral walls of the intermediate tray to a terminal end and each support post end including a central upwardly extending pin, said upper tray having recesses in the floor sized and configured to receive the pins of the support post of the intermediate tray and said upper tray having a central through recess sized and configured for a passage of the handle when the upper tray is in stacked relation with the lower and intermediate tray.

2. The carrier as set forth in claim 1 wherein the supply carrier is of rigid plastic material.

3. The supply carrier as set forth in claim 1 wherein the septums separate the interior of each of the trays into a plurality of generally rectangular compartments.

4. The supply carrier as set forth in claim 1 wherein the handle is sized for snug passage through the floor of the intermediate and upper tray to orient and maintain the trays in stacked relation.

* * * * *